US005525766A

United States Patent [19]

Atcheson et al.

[11] Patent Number: 5,525,766

[45] Date of Patent: Jun. 11, 1996

[54] PORTABLE ACOUSTICAL SHELL STRUCTURE

[75] Inventors: Richard R. Atcheson, East Palo Alto; Paul D. Butterfield, San Jose; Wilbert H. Rimper, East Palo Alto, all of Calif.

[73] Assignee: R & A Acoustical Structures, Palo Alto, Calif.

[21] Appl. No.: 344,382

[22] Filed: Nov. 23, 1994

[51] Int. Cl.[6] ..... E04B 1/99; A47G 5/00

[52] U.S. Cl. ..... 181/30; 160/135

[58] Field of Search ..... 181/30, 285, 287, 181/295; 160/135

[56] References Cited

U.S. PATENT DOCUMENTS

| | | | |
|---|---|---|---|
| 3,180,446 | 4/1965 | Wenger | 181/30 |
| 3,232,370 | 2/1966 | Jaffe et al. | 181/30 |
| 3,630,309 | 12/1971 | Wenger | 181/30 |
| 3,908,787 | 9/1975 | Wenger et al. | 181/30 |
| 5,403,979 | 4/1995 | Rogers et al. | 181/30 |

*Primary Examiner*—Khanh Dang
*Attorney, Agent, or Firm*—Feix & Feix

[57] ABSTRACT

A portable acoustical shell for the performing arts and the like, and which includes a plurality of generally quadrilateral, and preferably trapezoidal, sound reflecting panels arranged together as an assembly along adjacent long side edge margins in substantially abutting juxtaposed relation to form a forwardly open, arch-like configuration. The arch-like panel assembly is supported and held in place by a modular frame assembly formed from a plurality of pyramidal frame modules, each of which is associated with a respective one of the plurality of sound reflecting panels. The modular frame assembly further includes a number of cross members which connect the apexes of adjacent pyramidal frame modules to one another. In an alternate embodiment of the invention, the cross members are length-adjustable and thereby permit the arch-like curvature of the acoustical shell to be flattened or steepened as desired.

18 Claims, 6 Drawing Sheets

PORTABLE ACOUSTICAL SHELL STRUCTURE

BACKGROUND OF THE INVENTION

1. Field of the Invention

The present invention relates to portable acoustical shell constructions for instrumental and choral ensembles.

2. Description of the Prior Art

It is well known to use an acoustical shell to amplify and project the sound from a instrumental or choral ensemble outwardly towards a listening audience.

In addition to outward sound projection, an acoustical shell enables the individual performers to hear themselves and those around them so that they can make any necessary adjustments for intonation purposes without having to force their volume output in order to be heard. A good acoustical shell also provides a director with a more accurate impression of the balance between sections so that the director and performers can craft the combined sound more effectively.

For many indoor performance settings, such as, for example, concert halls, auditoriums or gymnasiums, the acoustics are less than ideal. In such indoor performance settings, an acoustical shell can help overcome the acoustical shortcomings of the performance area by keeping the sound from being lost to the sound-absorbing regions above the performance area, thereby allowing the performers to hear themselves better so that they can project a better blended sound to the audience.

Similarly, for outdoor performances, an acoustical shell can capture and redirect the upwardly directed sound back to the performers and to the listening audience.

Some desirable features of an acoustical shell include portability, light weight construction, low cost, simplicity of construction, ease of assembly and disassembly and compact stowage. In addition, it is further desirable that the acoustical shell be suitable for both indoor and outdoor use and be easily movable when fully assembled from one location to another, irrespective of any irregularities in the supporting ground surface whether the supporting ground surface is a concrete floor, a stage platform, soft earth or a grassy field.

Examples of various prior art portable acoustical shell structures are disclosed in U.S. Pat. Nos. 3,180,446, 3,232,370, 3,630,309 and 3,908,787. Such known prior art acoustical structures, however, typically are found lacking in one or more of the above noted desirable features. In particular, the expense associated with the construction of each of the above noted acoustical shell structures is typically high due to the amount of specialized tooling and parts required for their fabrication and assembly.

Further, the acoustic shells of the prior art as noted above are typically complex structures which are very heavy and awkward to move around once they are fully assembled. In an effort to convert these typically complex and heavy structures into a "portable" acoustic shell, the prior art teaches to employ casters, wheels, and like transport structure, so that the heavy and awkward acoustical shell can be wheeled or rolled from one location to another. Such transport structure is unsuitable for outdoor use on soft or unstable ground surfaces and further adds undesirable weight and complexity to the design and also adds to the overall cost of the acoustical shell.

Accordingly there is a definite need in the art for an improved portable, low cost and light weight acoustical shell which overcomes the problems of the prior art.

SUMMARY OF THE INVENTION

Briefly, the portable acoustical shell of the present invention comprises a plurality of generally quadrilateral, and preferably trapezoidal, sound reflecting panels which are arranged together as an assembly along adjacent long side edge margins in substantially abutting juxtaposed relation to form a forwardly open, arch-like configuration. The arch-like panel assembly is supported and held in place by a modular frame assembly in the form of an arched backbone support structure which spans the rearward surface region of the formed arch-like panel configuration.

The modular frame assembly comprises a plurality of pyramidal frame modules, each of which is associated with a respective one of the plurality of sound reflecting panels. The modular frame assembly further includes a number of cross members which connect the apexes of adjacent pyramidal frame modules to one another. The cross members in combination with the pyramidal frame modules form additional triangulated structure which enhances the overall rigidity of the modular frame assembly when fully assembled. Clip members and/or other like suitable disconnectable connecting elements are used to secure the panels in suspended fashion to the individual pyramidal frame modules.

The acoustical shell of the present invention is suitable for both indoor or outdoor use, irrespective of irregularities in the ground surface. For outdoor use, in particular, the modular frame assembly may further include additional base support structure including weighted elements in order to firmly anchor the acoustical shell on a ground surface and better resist wind gusts. The acoustical shell is of very lightweight design and can be easily lifted and moved around from one location to another by as few as two people.

The size or arch diameter of the acoustical shell may be increased or decreased as desired by adding or removing panels and their respective pyramidal frame modules. In addition, the cross members which connect the apexes of adjacently arranged pyramidal frame modules may include length-adjustment means, such as for example, a telescoping adjustment mechanism, in order to tailor the arcuate curvature of the acoustical shell structure from a truer arch-like configuration to a flatter elliptical arch configuration through the selective shortening or lengthening of the length-adjustable cross members.

It is an advantage of the present invention that the materials of construction selected for use in fabricating the acoustical shell preferably include inexpensive and readily available materials such as standard plastic sheet material for use as the panels and light-metal conduit or tubing for use as the modular frame assembly.

It is a further advantage of the present invention that special or expensive tooling is not required for fabrication of the acoustical shell.

It is a related advantage of the present invention that the acoustical shell can be quickly assembled and disassembled by unskilled labor using only simple hand tools.

Methods and apparatus which incorporate the features described above and which are effective to function as described above constitute specific objects of this invention.

These and other objects and advantages of the present invention will no doubt become apparent to those skilled in the art from the following drawings, detailed description of the preferred embodiment and the appended claims.

IN THE DRAWING

DESCRIPTION OF THE PREFERRED EMBODIMENT

The following detailed description illustrates the invention by way of example, not by way of limitation of the principles of the invention. This description will clearly enable one skilled in the art to make and use the invention, and describes several embodiments, adaptations, variations, alternatives and uses of the invention, including what we presently believe is the best mode of carrying out the invention.

Figure 1:
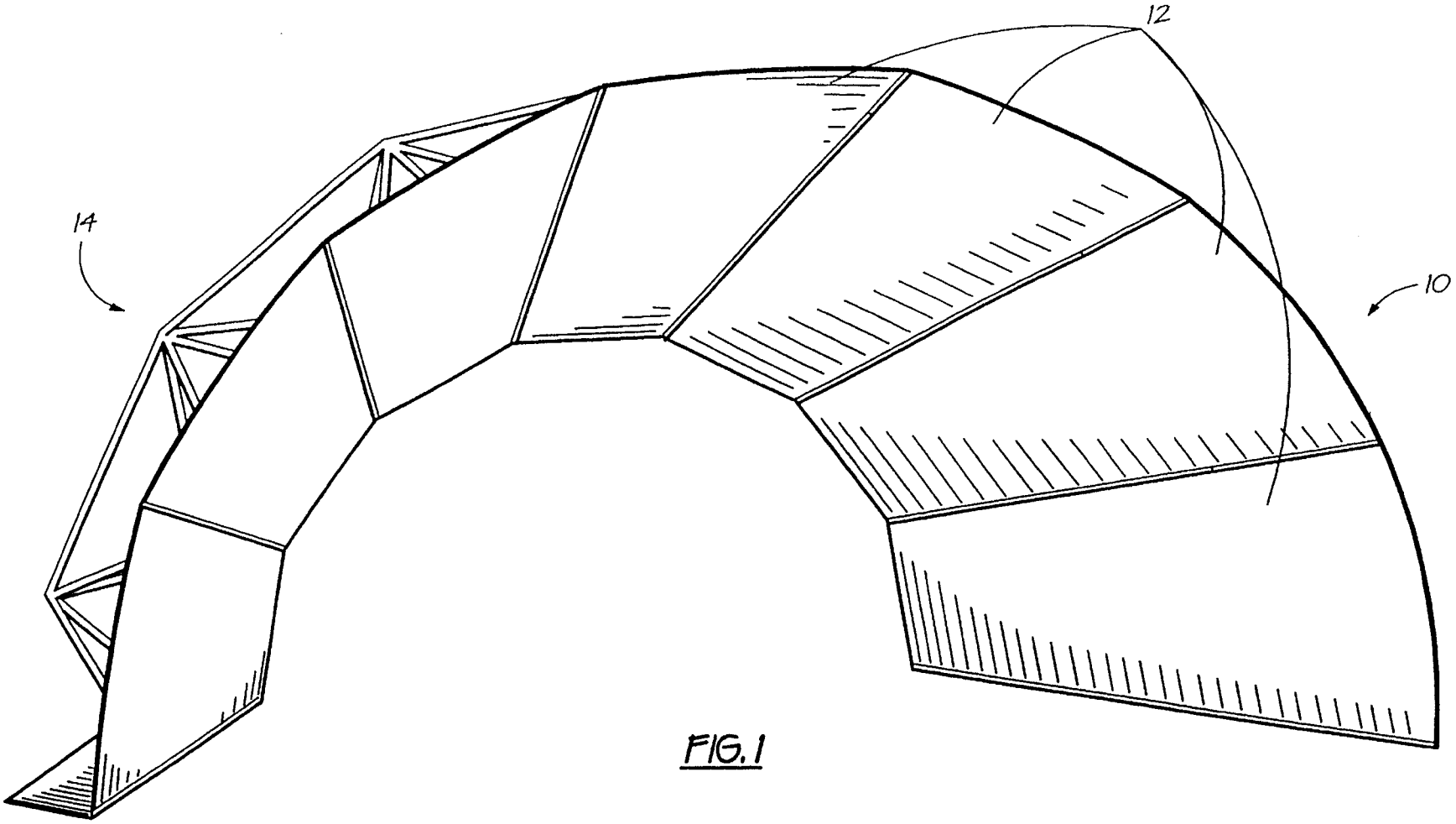
FIG. 1 is a front perspective view of the acoustical shell structure of the present invention.

An acoustical shell constructed in accordance with one embodiment of the present invention is indicated generally by the reference numeral 10 in FIG. 1.

The acoustical shell 10 comprises a sound-reflecting panel structure including a plurality of generally trapezoidal sound reflecting panels 12 arranged together along adjacent long side edge margins in substantially abutting juxtaposed relation to form the forwardly open, arch-like acoustical shell structure as shown. The sound-reflecting panels 12 are supported in place by a modular frame assembly 14 disposed spanning across the back or rear surface of the panel structure.

Figure 2:
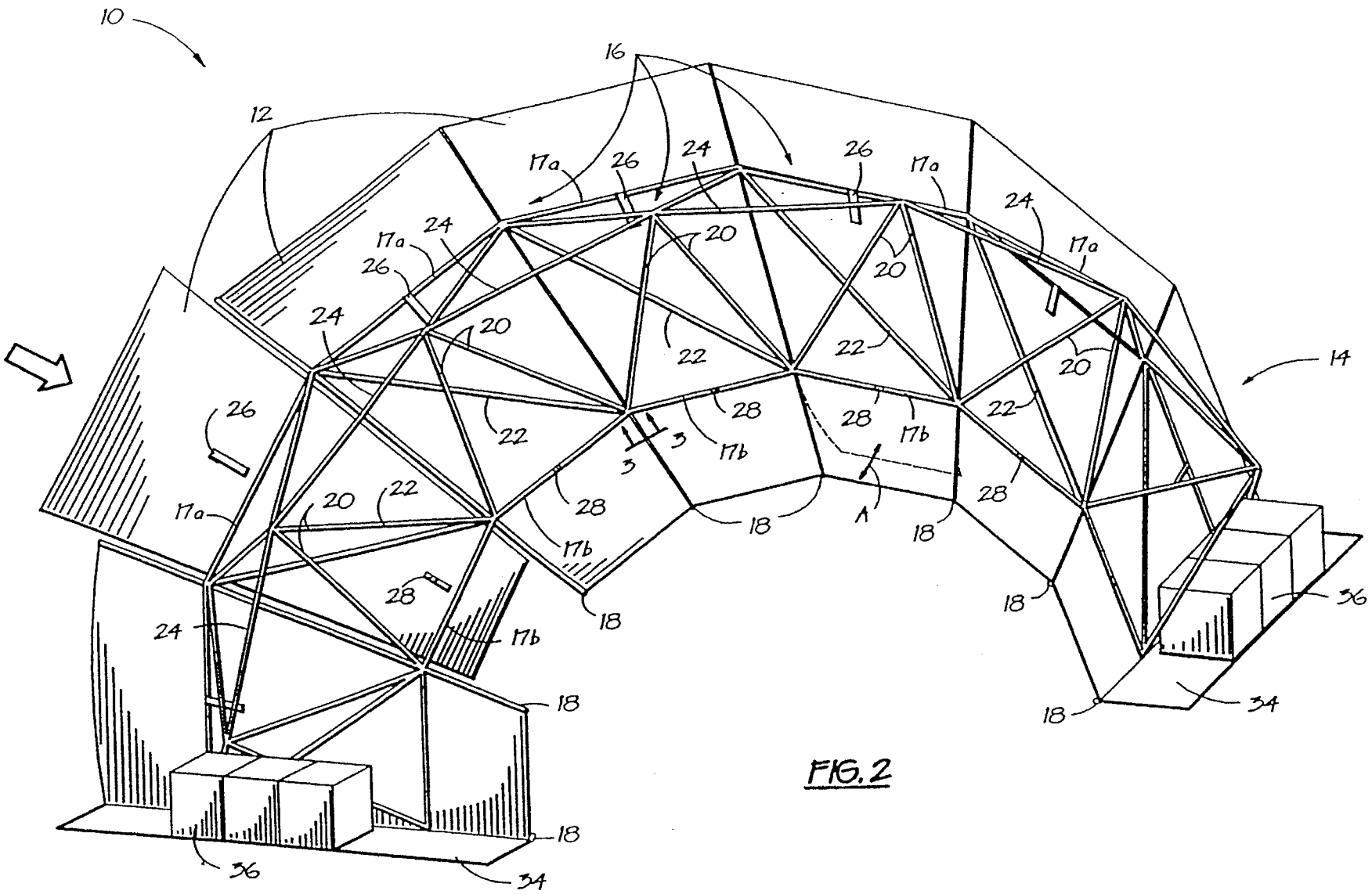
FIG. 2 is a rear perspective view of the acoustic shell structure of FIG. 1 and showing one acoustic panel being secured to a supporting modular frame assembly.
Figure 4:
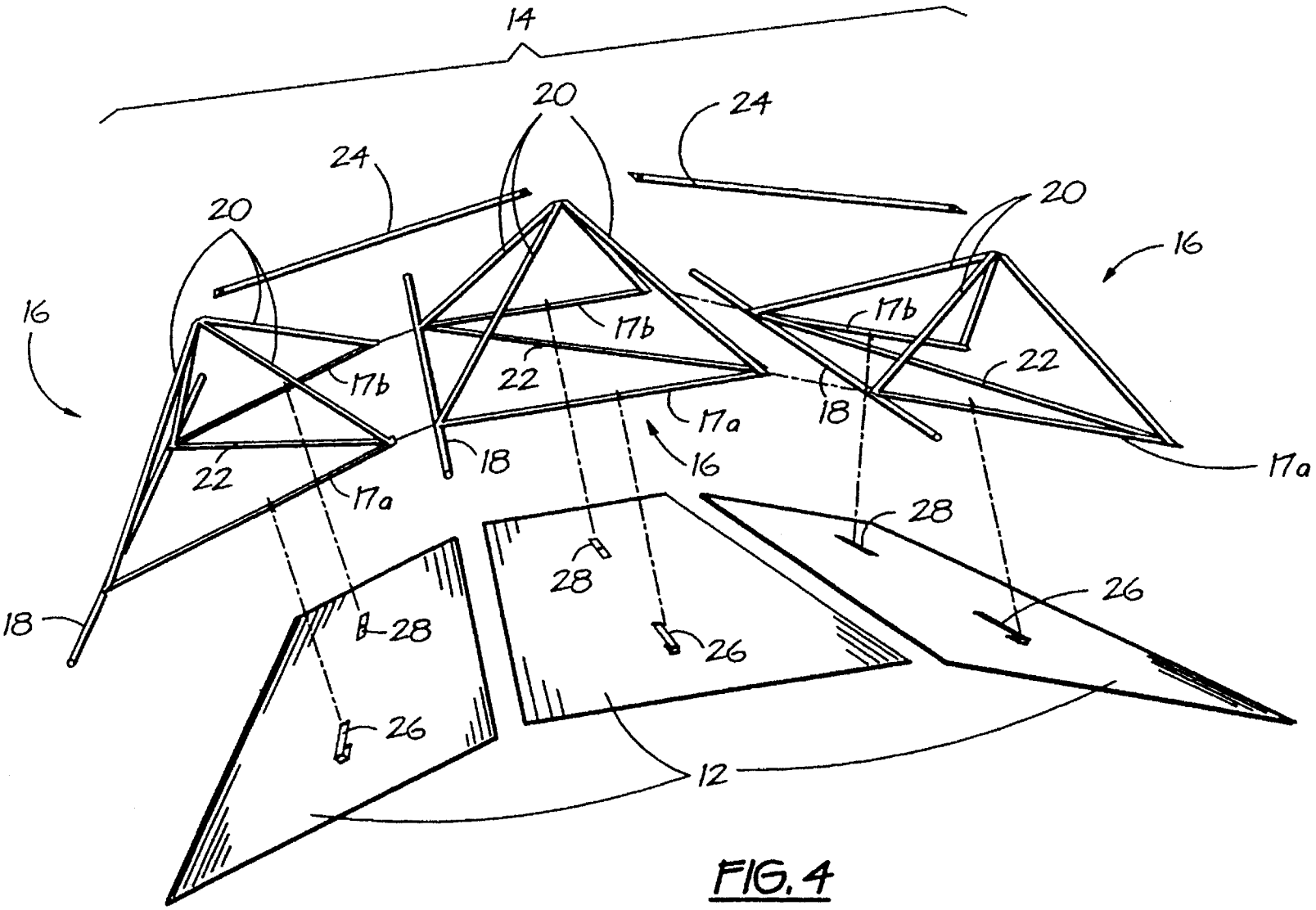
FIG. 4 is an exploded perspective view showing a plurality of acoustic panels of the acoustical shell structure and their respective supporting pyramidal frame modules.
Figure 5:
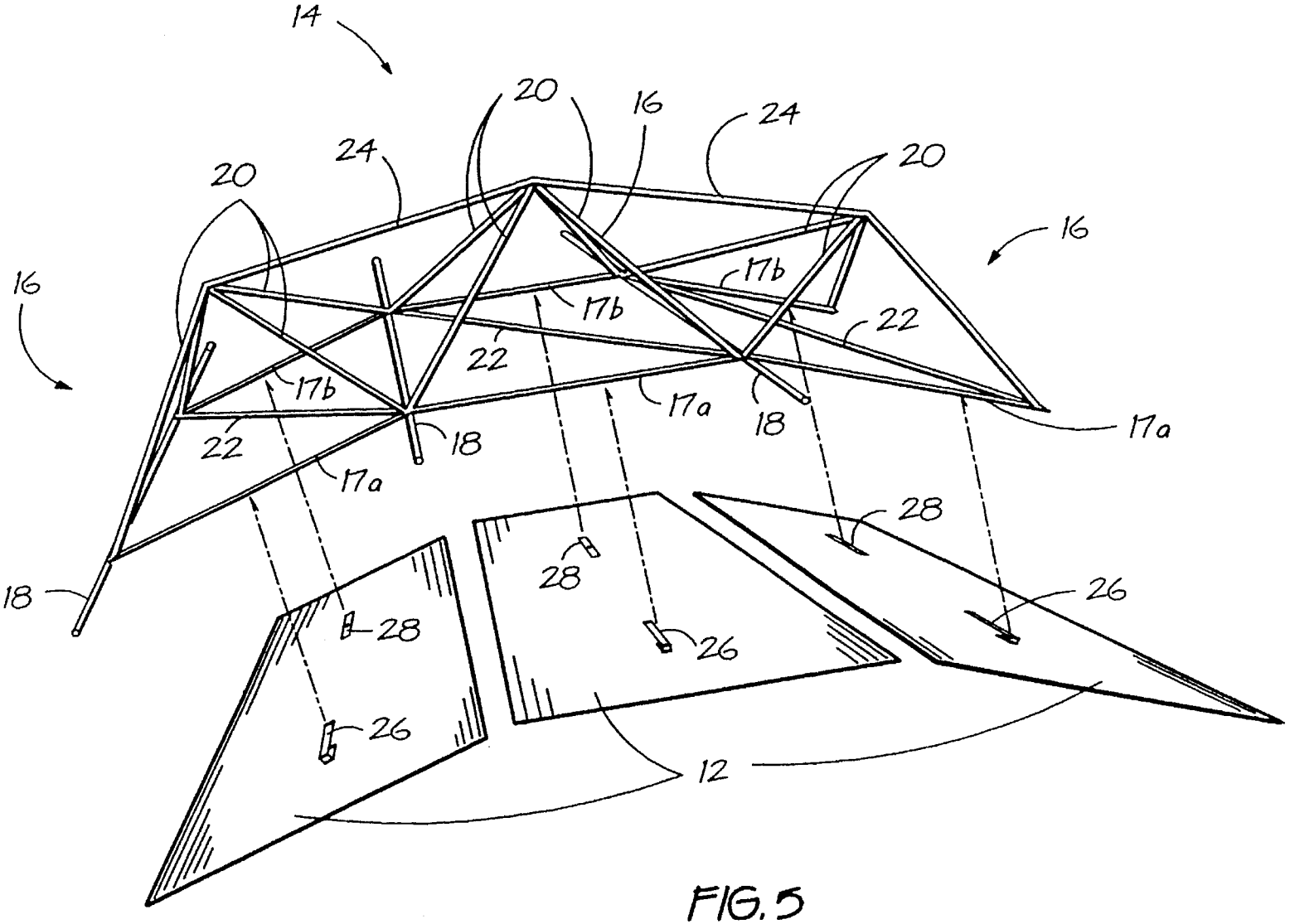
FIG. 5 is a perspective view similar to FIG. 4 but showing the pyramidal frame modules being joined together to form a portion of the modular frame assembly.

As best seen in FIGS. 2, 4 and 5, the modular frame assembly 14 is made up of a plurality of pyramidal frame modules 16. Each pyramidal frame module 16 is composed of a number of individual rigid frame members of selected lengths and which are secured together to form the pyramidal frame modules 16 as shown.

The generally square base structure of each pyramidal frame module 16 is bordered along three sides and includes two spaced apart and equal length base frame members 17*a*, 17*b* which are joined to an elongated base frame member 18. The side opposite the elongated frame member 18 is left open. Four substantially equal length frame members 20 extend upwardly from the four corners of the base structure and join together to form the apex of each pyramidal frame module 16.

In a preferred embodiment of the invention, the frame members comprise light-metal conduit or tubing. The individual frame members may be secured together by any number of conventional fastening or securing means including welding or use of glue adhesives, or by use of screw or bolt fasteners, with bolt fasteners being preferred. The ends of the metal conduit may be flattened and slotted or drilled with one or more holes for receiving the bolt fastener hardware.

In use, the individual pyramidal frame modules 16 are fastened together in serial fashion with the respective elongated base frame member 18 of each pyramidal frame module 16 joined to the base structure of an adjacent pyramidal frame module 16 along the open side end thereof. The base structure of each pyramidal frame module 16 may be further reinforced by frame members 22 which connect the diagonally opposed corners of the base structure as shown.

Additional frame members 24, herein referred to as cross members, connect the apexes of adjacent pyramidal frame modules 16 as shown. The combination of the cross members 24 and the pyramidal frame modules 16 provide a very rigid triangulated frame construction similar to a geodesic dome.

The sound reflecting panels 12 are preferably removably connected to the base frame members 17*a*, 17*b* of each pyramidal frame module 16 by releasably engagable hook-shaped clip members 26 and/or hook and loop fasteners 28 which are attached to the back or rear surface of the panels 12. Preferred hook and loop fasteners include VELCRO (a trademark) fasteners.

As is best seen in FIG. 1, the panels 12 are mounted to the frame assembly by sliding them in place with the clip members 26 engaging the forwardmost base frame members 17*a* of the pyramidal frame modules 16. The VELCRO fasteners 28 are then secured to the rearwardmost base frame members 17*b*.

Figure 3:
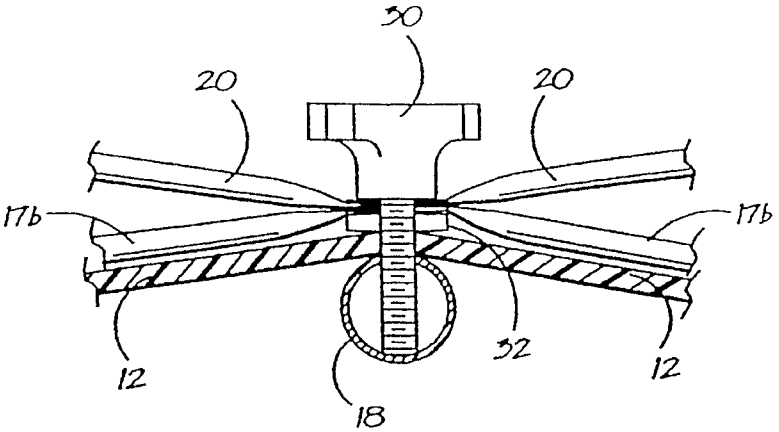
FIG. 3 is a cross section view of a panel joint region taken along the line and in the direction of arrows 3—3 of FIG. 2.

FIG. 3 illustrates in greater detail how the panels 12 are secured along the mutually adjacent sides to the lower or base corners regions of the pyramidal frame modules 16. A fastening element, such as bolt fastener 30 including a lock nut (not shown) and bearing element 32, is used to join the adjacent ends of the upwardly inclined frame members 20 and forwardmost base frame members 17*a* and to secure the adjoining long side edge margins of adjacent panels 12 to the common elongated frame member 18 in a sandwiched assembly by threaded engagement within a hole provided to the common elongated frame member 18. A similar connection is made at the adjacent forwardmost corner regions of the pyramidal frame modules 16. Each elongated frame member 18 provides a bearing surface for supporting the entire length of adjacent long side edges for two panels 12.

The above described connection of the panels 12 and the modular frame assembly 14 advantageously provides a suitably stable connection and at the same time allows the rear portion of the panels 12 to deflect upwardly and minimize lift due to wind gusts which may be encountered in an outdoor performance environment. The upward deflection of one of the panels 12 is designated generally by arrow A in FIG. 2 (the upwardly deflected panel is shown in phantom).

For outdoor performances in particular, the acoustical shell 10 preferably includes means for anchoring it to the ground to better resist inadvertent displacement, for example, due to wind gusts. As best seen in FIG. 2, one possible way to anchor the acoustical shell is to attach horizontal panel portions 34 to the outer and bottom most elongated frame members 18 of the modular frame assembly 14. Sandbags or like weighted elements 36 may then be placed on the panel portions 34 in any quantity as desired to firmly anchor the acoustical shell 10 to the ground. Other possible ways to anchor the acoustical shell 10 to the ground may include using tent stakes and tie downs (not shown).

The materials of construction for the panels 12 preferably include any light weight, rigid sheet material, with plastic sheet material being preferred. Especially suitable plastic sheet materials for use in the present invention include the family of polycarbonate sheet products sold under the trademark LEXAN by GE Plastics (a General Electric Company) of Pittfield, Mass. Other suitable plastic sheet materials include polyvinylchloride (PVC) foam board sold under the trademark SINTRA material by Alucobond Technologies, Inc. of Benton, Ky., and corrugated polyethylene plastic material.

The above plastics have been found desirable for use in the present invention as they are available in a wide range of transparent or opaque colors and can also be provided with abrasion and ultra violet (UV) resistant properties for long life.

In a preferred embodiment of the invention, the panels 12 are approximately 8 feet in length and have a long or front side edge width dimension of about 4 ft and a short or rear side edge width dimension in a range of about 1.5 ft to 3 ft. The number of panels and pyramidal frame modules may be varied to provide acoustical shell structures of different sizes as desired. For smaller performing groups of three to six persons, for example, a seven panel arrangement using panels with the above specified dimensional ranges will provide a suitable shell enclosure. Additional and or larger panels may be used to create a larger acoustical shell structures for larger performing groups as desired.

Alternatively, one or more shell enclosures, graduated in size from one to the next, may be combined in piggy back or nested fashion to form a single large shell enclosure as desired.

Also, while in the preferred embodiment the panels 12 are shown as being substantially planar, it is understood that the plastic panels can be cold formed or thermally formed to include simple and/or compound curvature in order to provide a wider range of useful acoustical shell configurations as desired.

Figure 6:
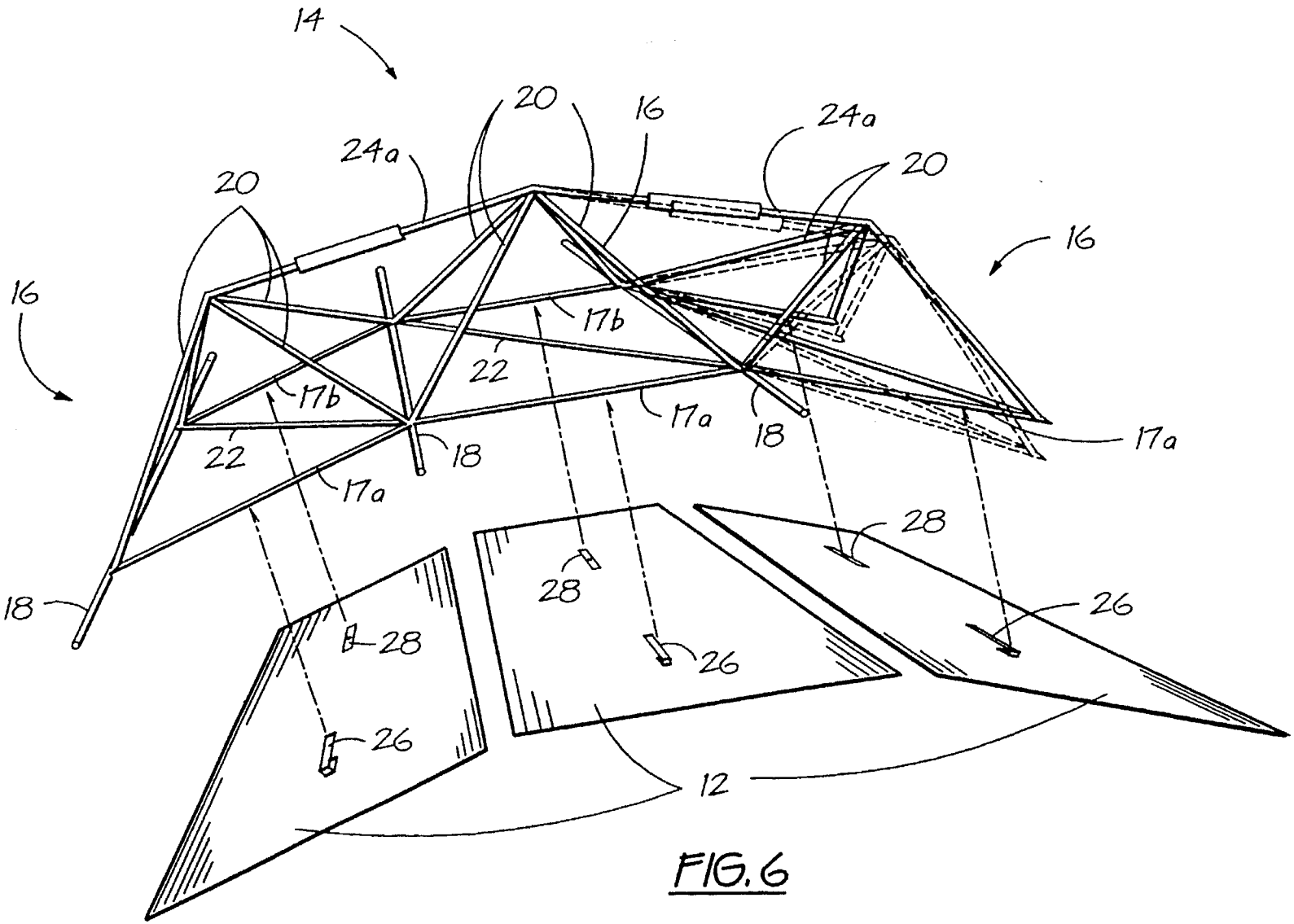
FIG. 6 is a perspective view similar to FIG. 5 but showing an alternate embodiment for the modular frame assembly wherein the respective pyramidal frame modules are linked together by length-adjustable cross members which, when shortened or lengthened, alter the cross-sectional configuration of the acoustical structure from generally semi-circular to more or less semi-elliptical.

FIG. 6 shows an alternate embodiment of the invention wherein length adjustable cross members 24*a* are used (in place of the fixed length cross members 24 shown in FIGS. 2, 4 and 5) to connect the apexes of adjacent pyramidal frame modules 16. The length-adjustable cross members 24*a* may comprise telescoping members (as depicted) or may simply be fixed length members provided with a number of different attachment points (eg. through-holes for receiving bolt fasteners) along its length and which may be selected in order to flatten or steepen the archlike curvature of the acoustic shell 10. A flattened or more elliptical curvature is obtained, for example, when the cross members 24*a* are shortened (the adjusted position of one frame module 16 is shown in phantom).

Figure 7:
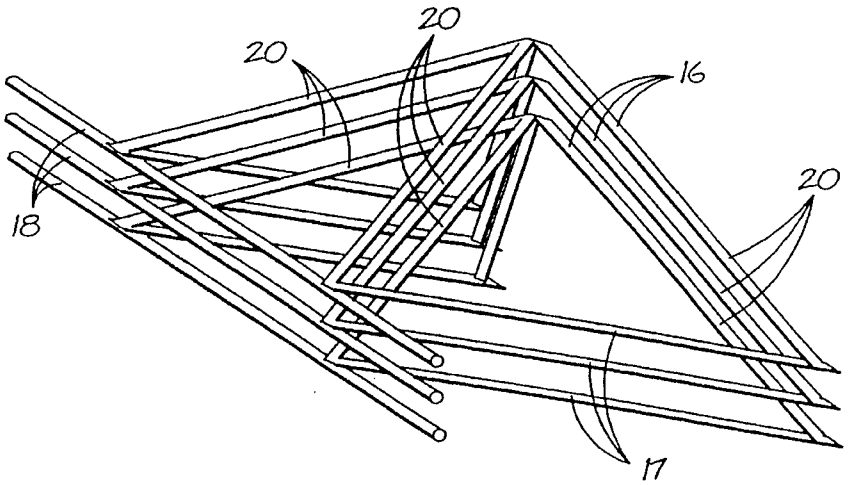
FIG. 7 is an isometric perspective view showing a plurality of the pyramidal frame modules in nested association.

The acoustic shell 10 of the present invention advantageously permits compact stowage without requiring much in the way of disassembly. To break down the shell, the VELCRO fasteners 28 are opened and the panels 12 are moved forwardly outward in order to disengage from the clip members 26. The panels 12 may then be stowed in a space saving stacked fashion. Next, the fasteners (not shown) which connect the cross members 24 to the apexes of adjacent frame modules 16 are unfastened and the cross members 24 removed. The fasteners 30 at the four corner regions of each pyramidal frame module 16 are then unfastened and the diagonal frame members 22 are removed. The pyramidal frame modules 16 may then be stacked in nested association without further disassembly (see FIG. 7).

It should be understood that various modifications within the scope of this invention can be made by one of ordinary skill in the art without departing from the spirit thereof. We therefore wish our invention to be defined by the scope of the appended claims as broadly as the prior art will permit, and in view of the specification if need be.

What is claimed is:

1. A portable acoustical shell structure for performing arts, comprising in operative combination:

a) a plurality of generally trapezoidal sound reflecting panels, each of said plurality of panels having a front surface, a rear surface, a rear edge margin, a front edge margin generally parallel to and spaced from said rear edge margin, and a pair of outwardly diverging long side edge margins extending from said rear edge margin to said front edge margin:

b) frame means for supporting said plurality of panels with said panels being arranged together along adjacent long side edge margins in substantially abutting juxtaposed relation to form a forwardly open, arch-like acoustical shell; wherein said frame means comprises a modular frame assembly formed in a generally arch-like configuration to provide a backbone support structure to said plurality of panels, said modular frame assembly including:

i) a plurality of pyramidal frame modules each associated to a respective one of said plurality of panels; and ii) a plurality of cross members for connecting respective apexes of said plurality of pyramidal frame modules; and c) connecting means for removably connecting the rear surface of each of said panels to said frame means.

2. The invention defined in claim 1 wherein said frame means further comprises anchor means connected to said modular frame assembly for anchoring the portable acoustical shell on a ground or floor surface.

3. The invention defined in claims 1 wherein said connecting means comprises clip members disposed on the respective rear surfaces of said plurality of panels for engaging the respective ones of said plurality of pyramidal frame modules.

4. The invention defined in claim 3 wherein said panels comprise semi-flexible plastic sheet material.

5. The invention defined in claim 4 wherein said plastic sheet material has ultraviolet (UV) resistant properties to withstand material degradation due to prolonged exposure to sunlight.

6. The invention defined in claim 1 wherein the cross members connecting the apexes of said pyramidal frame modules are length-adjustable such that the acoustical shell may be configured in a range of arch-like formations.

7. The invention defined in claim 6 wherein said frame means further comprises anchor means connected to said modular frame assembly for anchoring the portable acoustical shell on a ground or floor surface.

8. The invention defined in claim 6 wherein said connecting means comprises clip members disposed on the respective rear surfaces of said plurality of panels for engaging the respective ones of said plurality of pyramidal frame modules.

9. The invention defined in claim 8 wherein said panels comprise semi-flexible plastic sheet material.

10. The invention defined in claim 9 wherein said plastic sheet material has ultraviolet (UV) resistant properties to withstand material degradation due to prolonged exposure to sunlight.

11. A portable acoustical shell structure for performing arts, comprising in operative combination:

a) a plurality of generally trapezoidal sound reflecting panels, each of said plurality of panels having a front surface, a rear surface, a rear edge margin, a front edge margin generally parallel to and spaced from said rear edge margin, and a pair of outwardly diverging long side edge margins extending from said rear edge margin to said front edge margin;

b) a modular frame assembly for supporting said plurality of panels with said panels being arranged together along adjacent long side edge margins in substantially abutting juxtaposed relation to form a forwardly open, arch-like acoustical shell; wherein said modular frame assembly is defined as a generally arch-like backbone support structure and includes:

i) a plurality of pyramidal frame modules each associated to a respective one of said plurality of panels;

ii) a plurality of cross members for connecting respective apexes of said plurality of pyramidal frame modules; and c) disconnectable connecting members for connecting the rear surface of each of said panels to said modular frame assembly.

12. The invention defined in claim 11 wherein said modular frame assembly further includes means for anchoring the portable acoustical shell on a ground or floor surface.

13. The invention defined in claim 11 wherein said panels comprise semi-flexible plastic sheet material.

14. The invention defined in claim 13 wherein said plastic sheet material has ultraviolet (UV) resistant properties to withstand material degradation due to prolonged exposure to sunlight.

15. The invention defined in claim 11 wherein the cross members connecting the apexes of said pyramidal frame modules are length-adjustable such that the acoustical shell may be configured in a range of arch-like formations.

16. The invention defined in claim 15 wherein said modular frame assembly further comprises means for anchoring the portable acoustical shell on a ground or floor surface.

17. The invention defined in claim 15 wherein said panels comprise semi-flexible plastic sheet material.

18. The invention defined in claim 17 wherein said plastic sheet material has ultraviolet (UV) resistant properties to withstand material degradation due to prolonged exposure to sunlight.

* * * * *